US008137136B1

(12) United States Patent
Bench

(10) Patent No.: US 8,137,136 B1
(45) Date of Patent: Mar. 20, 2012

(54) ELECTRICAL DISCONNECT FOR HAZARDOUS AREAS

(75) Inventor: Jason Bench, San Diego, CA (US)

(73) Assignee: Precision Engine Controls Corporation, San Diego, CA (US)

( * ) Notice: Subject to any disclaimer, the term of this patent is extended or adjusted under 35 U.S.C. 154(b) by 0 days.

(21) Appl. No.: 13/149,083

(22) Filed: May 31, 2011

(51) Int. Cl.
*H01R 13/58* (2006.01)

(52) U.S. Cl. ..... 439/604

(58) Field of Classification Search ..... 439/604, 439/936, 276, 320; 29/858
See application file for complete search history.

(56) References Cited

U.S. PATENT DOCUMENTS

| | | | | |
|---|---|---|---|---|
| 3,068,332 | A | 12/1962 | Jeffrey | |
| 3,210,608 | A | 10/1965 | Appleton | |
| 3,246,110 | A | 4/1966 | Hermanson et al. | |
| 3,268,988 | A | 8/1966 | Palen | |
| 4,628,392 | A | 12/1986 | Didier | |
| 5,104,340 | A * | 4/1992 | Elam et al. | 439/604 |
| 5,208,427 | A * | 5/1993 | Couto et al. | 174/653 |
| 5,704,799 | A * | 1/1998 | Wood | 439/281 |
| 6,319,073 | B1 | 11/2001 | Menolotto et al. | |
| 6,392,322 | B1 | 5/2002 | Mares et al. | |
| 6,446,519 | B1 | 9/2002 | Biester | |
| 6,623,289 | B2 * | 9/2003 | Decicco | 439/271 |
| 6,716,063 | B1 * | 4/2004 | Bryant et al. | 439/589 |
| 6,918,788 | B2 * | 7/2005 | Cavanaugh | 439/587 |
| 7,069,137 | B2 | 6/2006 | Miller | |
| 7,175,460 | B2 * | 2/2007 | Tschope et al. | 439/276 |
| 7,507,105 | B1 * | 3/2009 | Peters et al. | 439/374 |
| 2004/0216782 | A1 | 11/2004 | Mares et al. | |

* cited by examiner

*Primary Examiner* — Tulsidas C Patel
*Assistant Examiner* — Harshad Patel
(74) *Attorney, Agent, or Firm* — Carlson, Gaskey & Olds P.C.

(57) ABSTRACT

An explosion-resistant connector has a receptacle having a female portion and a first outer portion. A plurality of leads extends through the receptacle into the female portion. An adapter has a hollow portion through which the leads also extend, the adapter attaching to the first outer portion. A potting compound is disposed in the hollow portion about the leads. If an explosion occurs, it occurs on an adapter side of the connector as opposed to a receptacle side of the connector.

20 Claims, 2 Drawing Sheets

ELECTRICAL DISCONNECT FOR HAZARDOUS AREAS

FIELD

This invention relates generally to electrical switches and more particularly to explosion-resistant quick-connect conductors.

BACKGROUND

Electrical actuators may be used in explosion prone areas in which explosive gases, such as oxygen and fuel may cause ignition by arcing of switch contacts or other contacts. Some switches have been developed that contain explosions within a particular area to minimize damage from explosion to areas remote from such explosions. Such connectors must also provide suitable or minimal flame paths that may be generated from such explosions to further minimize damage that may occur.

Some explosion-resistant electric conductors use "flying lead" connectors that use a rigid conduit with a concretely set seal that acts as a barrier. In the "flying lead" application, disconnection of the connector without damaging its attendant parts is very difficult if not impossible.

SUMMARY

According to an embodiment shown herein, an explosion-resistant connector has a receptacle having a female portion and a first outer portion. A plurality of leads extends through the receptacle into the female portion. An adapter has a hollow portion through which the leads also extend, the adapter attaching to the first outer portion. A potting compound is disposed in the hollow portion about the leads. If an explosion occurs, it occurs on an adapter side of the connector as opposed to a receptacle side of the connector.

According to an embodiment shown herein, a method for constructing an explosion-resistant connector includes screwing a female receptacle having a plurality of leads extending therein into an adapter having a hollow portion therein through which the leads also extend, fitting a snap ring within a wall of receptacle defining the hollow portion within the adapter, and filling the hollow portion of the adapter with a potting compound.

These and other features of the present invention can be best understood from the following specification and drawings, the following of which is a brief description.

DETAILED DESCRIPTION OF THE PREFERRED EMBODIMENT

Figure 1:
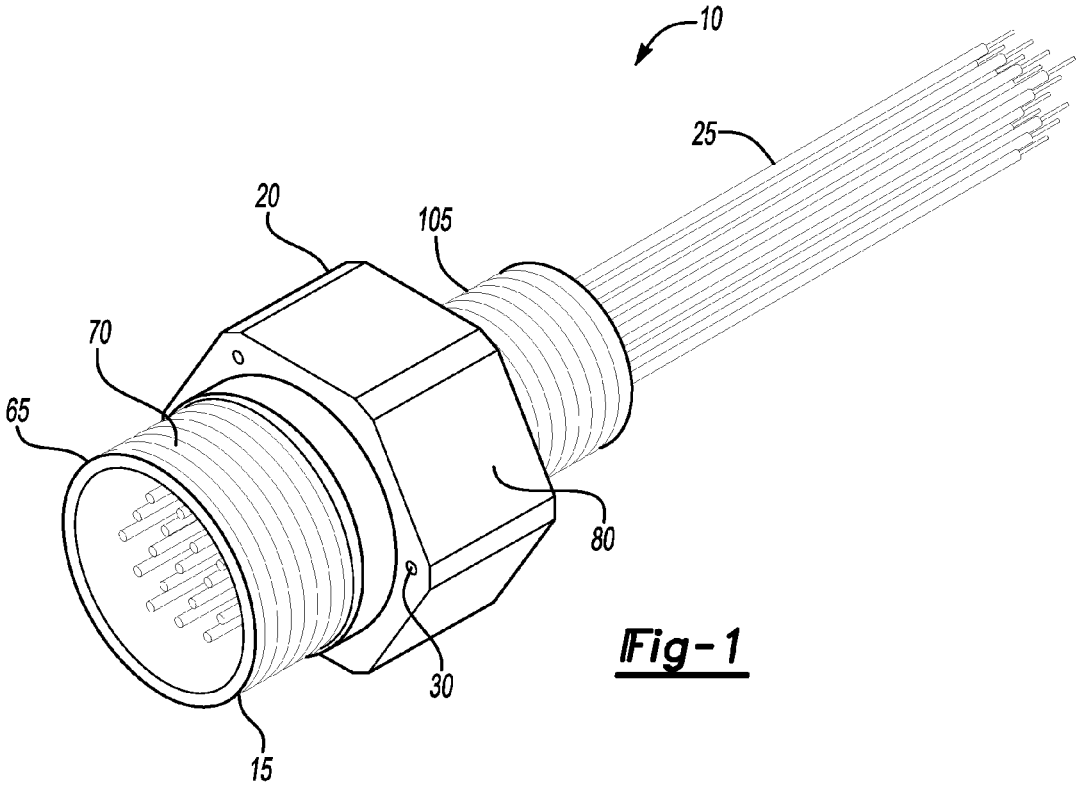
FIG. 1 is a perspective view of a connector shown herein.

Referring now to FIG. 1, an explosion-resistant connector 10 is shown. The connector 10 has an off the shelf circular pin and sleeve receptacle 15 (herein after referred to as receptacle) and National Pipe Thread Tapered (NPT) threaded adapter (hereinafter referred to as an adapter) and a plurality of leads 25 or wires. The adapter 20 has a plurality of axially drilled holes 30 to attach to a connecting nut 35 as shown in FIG. 2 and as will be discussed infra.

Figure 2A:
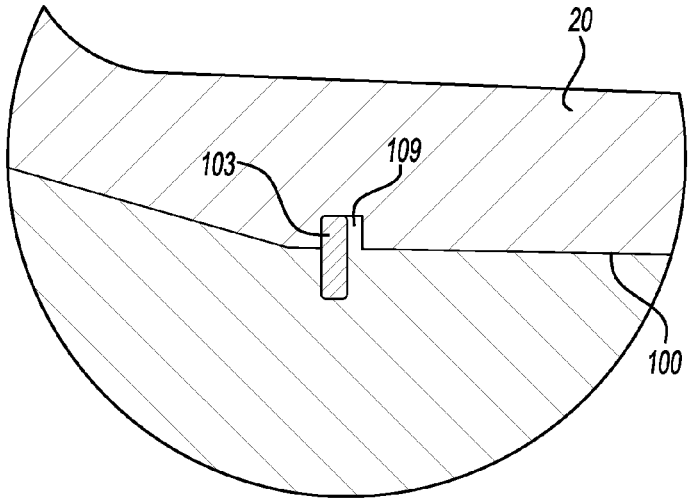
FIG. 2A is a section noted as 2A of FIG. 2.
Figure 2:
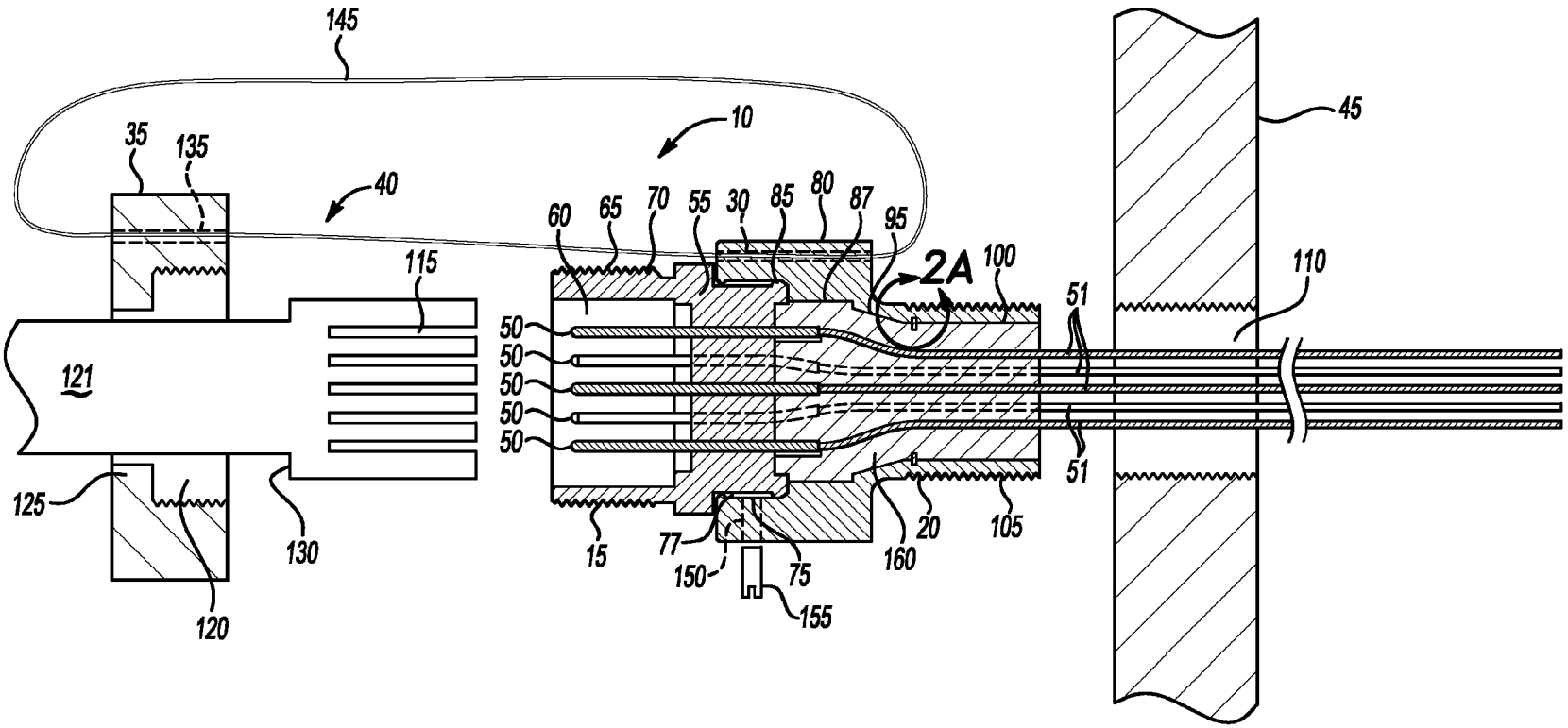
FIG. 2 shows a connector of FIG. 1 in conjunction with incoming leads in a conjunction block.

FIG. 2 shows a cross-sectional view of the connector 10 of FIG. 1 in conjunction with a socket block 40 and a schematically-shown junction box 45.

The receptacle 15 has a first end 50 of leads 25 extending axially within a cup-like enclosure 60, which acts as a female portion of the connector 10, towards the socket block 40, which acts as a male portion. The leads 50 extend through a body 55 of the receptacle 15 and are soldered or otherwise attached to wires 51 and through the adapter 20 as will be discussed infra. The enclosure 60 has a circular wall 65 and has a threaded surface 70. The body 55 has a threaded surface 75 on a circumferential wall 77 thereof.

The adapter 20 has a hexagonal outer wall 80 that has a threaded first inner bore 85. A second inner bore 87 is contiguous to the first inner bore 85 and is disposed axially away from the socket block 40. The second inner bore 87 has a smaller diameter than the first inner bore 85. A portion 95 tapers towards the junction box 45 and joins with a third inner bore 100 that has a smaller diameter than the second inner bore 87. A threaded outer wall 105 encloses a piece of the portion 95 and the third inner bore 100. The leads 25 extend through the first, second and third inner bores 85, 87, 100 and through the portion 95 for insertion on the junction box 45. The junction box 45, shown schematically, has an opening 110 that is threaded for mating with the threaded outer wall 105.

Referring to FIG. 2A, a ring 103, which is made out of a spring steel or other suitable material, is snap inserted into the third inner bore 100 into a groove 109, which may be square or other shaped for retention therein. The groove 109 is wider than the ring 103.

The socket block 40 has a plurality of openings 115 that are sized to connect with and electrically conduct with the first ends 50 of the leads 25. The socket block 40 is attached to a cable 121 that may be flexible. The socket block 40 fits within enclosure 60. The nut 35 has an inner bore 120 that is threaded to screw onto threaded surface 70. A shoulder 125, which has a smaller diameter than the inner bore 120, abuts an extension 130 on the socket block 40 if the nut 35 is screwed onto the threaded surface 70 to hold the socket block 40 on the receptacle 15.

Both the nut 35 and the adapter 20 each have an opening 135 and 30, respectively, so that a connecting wire 145 may be threaded therethrough after connection of the nut 35 to the threaded surface 70 of the receptacle 15 to ensure, after being pulled taut that the socket block 40 is not disconnected from the adapter 20.

The adapter 20 has an opening 150 through which a set screw 155 may be inserted and torqued down against the receptacle to ensure that the adapter 20 does not disconnect from the receptacle 15 after connection thereto.

To construct the connector 10, the receptacle 15 is screwed into the adapter 20. Teflon tape (not shown) may be placed between the receptacle 15 and the adapter 20 to minimize leakage of potting compound 160 before it is cured. The set screw 155 is screwed into the opening 150 against threaded surface 70 and 75 that ensure that the adapter 20 and the receptacle 15 do not separate. A potting compound 160, which may be epoxy based such as Stycast® epoxy from Emerson & Cuming, is then induced into the bores 85, 87, 100 and portion 95 of the adapter 20. After the potting compound 160 sets, the connector 10 is screwed into opening 110 of the junction box 45. The socket block 40 may then be inserted into the receptacle 15 in which the first ends 50 fit within openings 115. Nut 35 screws onto surface 70 of the receptacle 15 and the shoulder 125 impinges against extension 130 to fix the socket block 40 within the receptacle 15. The nut 35 acts as a clamp thereby to force connection of the socket block 40 to the receptacle 15. Wire 145 is then threaded through axial openings 135 and 30 in the nut 35 and the adapter 20 respectively to act as a visible cue that the nut 35 is properly connected to the receptacle 15 and to minimize a probability that the nut 35 would unscrew from the receptacle 15.

The potting compound 160 cooperates with the material of the adapter 20 and the snap ring 103 to form a bond within the receptacle so that any explosion that occurs to the right of junction box 45, as shown in the drawing, does not escape through the connector 10 to the left side of the junction box 45. One of ordinary skill in the art will recognize that the junction box 45 is representative of any wall that may minimize the forces of an explosion from moving from one side to another side to protect componentry and other parts on the other side of the wall.

By using this type of connector 10, should the connector 10 have to be removed, the wire 145 may be cut and removed and the nut 35 may be unscrewed from the receptacle 15. The connector 10 may then be unscrewed from the junction box 45 to enable repair or replacement thereof.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. An explosion-resistant connector, said connector comprising:

a receptacle have a female portion and a first outer portion;

a plurality of leads extending through said receptacle into said female portion;

an adapter having a hollow portion through which said leads extend, said adapter attaching to said first outer portion; and a potting compound disposed in said hollow portion about said leads and wherein an explosion may occur on an adapter side of said connector as opposed to a receptacle side of said connector.

2. The connector of claim 1 further comprising:

a socket block inserted into said receptacle for mating with said leads, said receptacle having a second outer portion; and a nut having a first inner surface for mating with said second outer portion.

3. The connector of claim 2 further comprising:

said nut having a second inner portion for mating with an extension of said socket block to clamp said socket block in said receptacle.

4. The connector of claim 2 further comprising:

a flexible cable attaching to said socket block.

5. The connector of claim 2 further comprising:

said nut having a first axial opening;

said adapter having a second axial opening; and a lead extending through said first axial opening and said second axial opening.

6. The connector of claim 1 further comprising:

said adapter having a threaded radial opening; and a set screw for insertion in said radial opening to lock said adapter to said receptacle.

7. The connector of claim 1 further comprising:

said first outer portion of said receptacle is threaded; and said adapter has a first inner bore having a thread portion for mating with said threaded first outer portion of said receptacle.

8. The connector of claim 7 wherein said receptacle further comprises:

a second inner bore having a diameter that is less than the diameter of the first inner bore and disposed more remotely from said receptacle than said first inner bore.

9. The connector of claim 8 wherein said receptacle further comprises:

a third inner bore having a diameter that is less than the diameter of the second inner bore and disposed more remotely from said receptacle than said second inner bore.

10. The connector of claim 9 wherein said second inner bore and said third inner bore are connected by a tapered portion.

11. The connector of claim 1 further comprising:

a groove disposed in a wall of said adapter; and a ring disposed in said groove and extending into said hollow portion of said adapter for fixing said potting compound within said hollow portion.

12. The connector of claim 1 wherein said potting compound fills said hollow portion.

13. The connector of claim 1 wherein said adapter further comprises a threaded outer portion for engaging a threaded portion of a wall.

14. The connector of claim 13 wherein said threaded portion is disposed externally of and in register with an inner cylindrical portion of said adapter and a tapered portion of said adapter.

15. The connector of claim 13 wherein said wall is a junction box.

16. A method for constructing an explosion-resistant connector comprising:

screwing a female receptacle having a plurality of leads extending therein into an adapter having a hollow portion therein through which said wires also extend;

fitting a snap ring within a wall of an inner bore defining said hollow portion within said adapter; and filling said hollow portion of said adapter with a potting compound.

17. The method of claim 16 further comprising:

attaching a socket block to said leads within said female receptacle; and screwing a nut onto an external surface of said receptacle to lock said socket block in said receptacle.

18. The method of claim 16 further comprising:

screwing said adapter into a wall wherein an explosion may occur on one side of said wall and said receptacle and a portion of said adapter is on another side of said wall.

19. The method of claim 16 further comprising:

extending a wire through an axial opening in said nut and said adapter.

20. The method of claim 16 further comprising:

extending a set screw through said adapter into contact with said receptacle before filling said hollow portion with said potting compound.

* * * * *